United States Patent [19]

Klem

[11] 4,349,046

[45] Sep. 14, 1982

[54] HYDRAULIC VALVE BLOCK MOUNTING

[75] Inventor: John E. Klem, Waukegan, Ill.

[73] Assignee: International Harvester Co., Chicago, Ill.

[21] Appl. No.: 187,237

[22] Filed: Sep. 15, 1980

[51] Int. Cl.[3] ..... F16L 3/00

[52] U.S. Cl. ..... 137/899; 137/596

[58] Field of Search ..... 137/351, 354, 355, 899, 137/596; 180/90, 312

[56] References Cited

U.S. PATENT DOCUMENTS 1,120,996 12/1914 Bronson .

3,200,646 8/1965 Donko et al. ..... 73/317

3,968,896 7/1976 Giacoletti et al. ..... 220/63 R 4,096,878 6/1978 Adams et al. ..... 137/351

4,178,004 12/1979 Shinoda et al. ..... 280/5 A

*Primary Examiner*—Martin P. Schwadron

*Assistant Examiner*—John A. Rivell

*Attorney, Agent, or Firm*—D. K. Sullivan; F. D. Au Buchon

[57] ABSTRACT

A valve mounting plate is positioned over an access port in the front portion of the chassis of a large earth-working vehicle. A large hydraulic valve assembly is attached to the inboard surface of the valve mounting plate so that the valve resides in an accessible interior frame member compartment.

8 Claims, 2 Drawing Figures

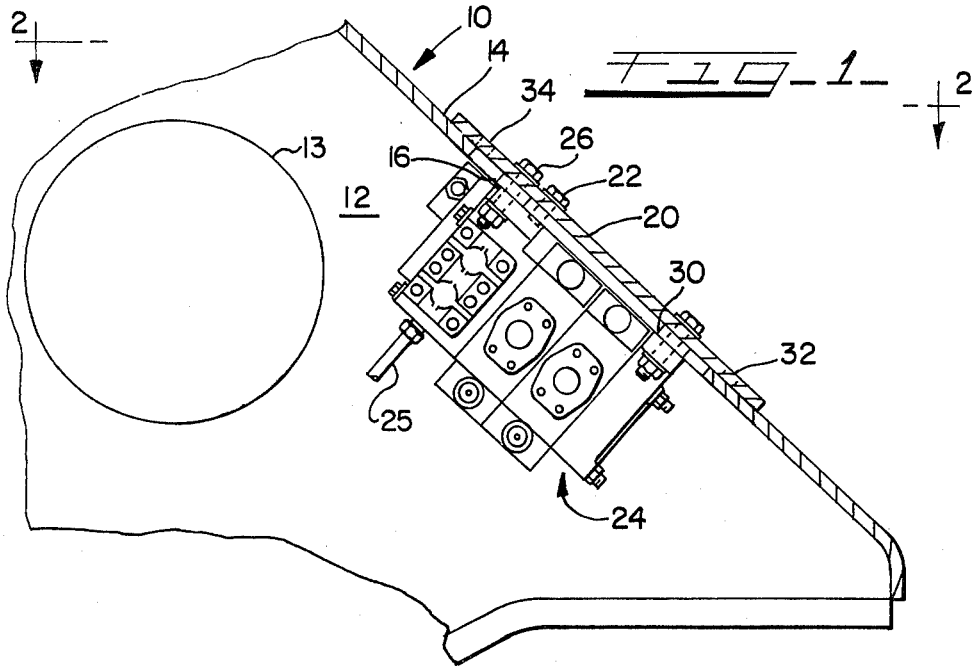
FIG. 1
FIG. 2
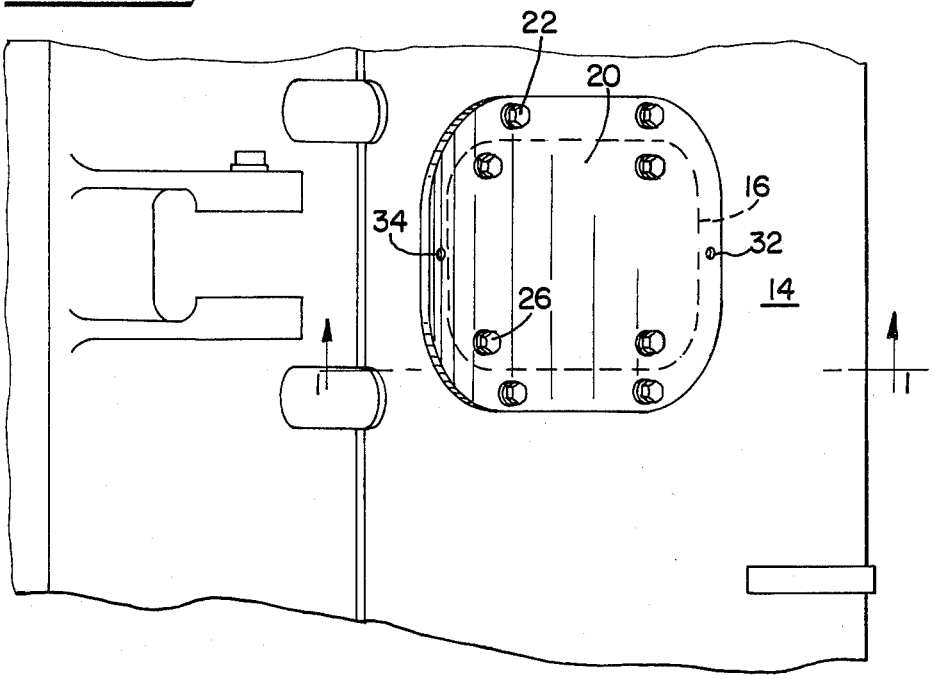

HYDRAULIC VALVE BLOCK MOUNTING

BACKGROUND OF THE INVENTION

1. Field of the Invention

This invention has to do with mounting apparatus for attaching cumbersome hydraulic valve assemblies inside partially enclosed compartments of earthworking vehicles.

2. Description of the Prior Art

In large off-highway articulated construction loader vehicles many of the vehicle functions are controlled hydraulically. The loader boom, bucket, articulating steering cylinders and the vehicle transmission are hydraulically controlled resulting in the necessity of controlling the movement of large quantities of hydraulic fluid. Controls for directing this fluid are necessarily large, heavy and bulky. On prior art articulated loader vehicles the hydraulic valve bodies were ganged together to form a valve bank and installed inside the front portion of the vehicle. The engine is located behind the articulation point and since there isn't front axle steering (due to the articulated steering) the front portion of the chassis above the front axle and between the forwardly extending boom arms presents a large vacant chamber ideally suited for housing the hydraulic valve component bank.

To install the valve bank several men worked from under and inside this front portion in cramped quarters locating and bolting in the heavy bulky valve bank. Proper alignment and location is very difficult as the valve bank, which weighs several hundred pounds, has to be jockeyed into position.

After the valve bank is bolted into position it is attached to the various fittings, such as hydraulic lines and control apparatus, by a man working inside the front portion. This is possible as the front portion has an open bottom to provide access to the hydraulic valve bank. Additional man access ports may also be provided in the sidewalls of the front portion.

The prior art contains apparatus having working components attached to flanged mounting plates. Typical of these devices are fuel tank gauge sending units. These devices are distinguished from the instant invention by the environment and necessity of their design. They are always used in enclosed tanks (neglecting fill and drain ports) as contrasted with the open access structure of this invention. The fuel tank gauges are usually light in weight and small in size and most importantly do not require the attachment of numerous hydraulic lines, fittings and controls after they are positioned in the tank. A typical fuel tank does not provide access to allow a person to work inside it to attach and detach various fittings. All fittings are attached before the fuel gauge is installed in the tank.

Of course it is also known in the prior art to mount the valve bank externally on the vehicle thus making fitting attachment easy.

SUMMARY OF THE INVENTION

A valve bank mounting assembly is provided for a front portion of an articulated vehicle in an open compartment having, iner alia, a top panel. The top panel is provided with an opening or aperture to accept the entry of the valve bank as it is lowered into the front portion compartment. The valve bank itself is mounted to a mounting plate having dimensions larger than the opening in the top panel to prevent the passage of the mounting plate into the compartment. The top panel and the mounting plate are equipped with aligned apertures to accept the fasteners for maintaining the mounting plate and the attached valve bank in proper position with respect to the top panel.

A plurality of threaded holes are also provided in the valve bank mounting plate. These holes are provided to accommodate lifting eyes for facilitating the attachment of a lifting hoist. The lifting eyes are threaded into the mounting plate threaded holes. A number of spacers, or a single spacing plate, having a thickness corresponding to the thickness of the top panel of the open compartment, may be provided between the hydraulic valve bank and the mounting plate. This enables the invention to be retrofitted to previously produced vehicles without effecting the length or position of attachment fittings.

It is among the objects of this invention to provide a hydraulic valve mounting assembly that will reduce the mounting time and increase the service access of a hydraulic valve bank mounted in the front portion of an articulated vehicle.

Another object of the invention is to provide a hydraulic valve bank that can be hoisted out or lowered into the open compartment of the front portion of an articulate vehicle.

Also an object of this invention is to provide a hydraulic valve bank mounting arrangement that can be retrofitted to machines not equipped with this invention without the need of modifying the preexisting hydraulic valve bank or its attendent plumbing and fittings. These and other advantages of the invention will be apparent from a perusal of this specification in conjunction with the attached drawing figures.

BRIEF DESCRIPTION OF THE DRAWING FIGURES

FIG. 1 is a side elevation view through plane 1—1 of FIG. 2 showing a front portion of an articulated loader vehicle having portions broken away to reveal a partially sectioned embodiment of the invention;

FIG. 2 is a top plan view of a front portion of an articulated loader vehicle having portions broken away.

DETAILED DESCRIPTION OF THE DRAWING FIGURES

The drawing figures show a portion of the front frame structure of a large articulated earthmoving loader, generally 10 with a right side portion removed to reveal the inside of the front frame structure. A portion of the left sidewall 12 is thereby exposed as is a portion of the top plate 14. The sidewall 12 is provided with an access opening 13 to facilitate the entry of a workman within the front frame structure 10. The top plate 14 is provided with a large generally rectangular valve bank access port or opening 16 generally centrally located on the downwardly sloping top plate of the forward portion of the vehicle.

Covering the access port 16 and adjacent the outer surface of the top plate is a valve mounting plate 20 that is larger than the opening of the access port 16 and significantly overlaps the edges of the access port opening. The valve mounting plate 20 is equipped with a plurality of small apertures and is fastened to the top plate 14 of the front frame structure generally 10 the top plate also having a plurality of small apertures for alignment with those of the valve mounting plate, with a first surface of the valve mounting plate in a face-to-face relationship with the outer surface of the top plate, through the use of a plurality of fasteners exemplified by bolt 22.

A plurality of hydraulic valve assemblies integrated into a single hydraulic valve bank generally 24 is mounted by fasteners such as 26 to the inside surface of valve mounting plate 20. Several hydraulic lines and fittings, such as pilot control line 25, of the vehicle hydraulic system are conventionally attached to the valve bank 24 within the front frame structure.

It is important to note that the hydraulic valve bank is spaced away from the inside surface of valve mounting plate 20 through the use of spacers such as 30. The spacers 30 are ideally of the same thickness as the thickness of the top plate 14. The reason for this is that if the valve mounting plate system set forth herein is retrofitted to earlier model machines the plumbing, fittings and hydraulic lines and controls can be connected to the hydraulic valve bank without the need for shortening or lengthening hydraulic lines, reangling hydraulic fittings or rerouting valve control levers.

Although a preferred embodiment would utilize spacers 30 as shown it is also contemplated that a full size spacer plate, somewhat smaller than the size of the opening 16 in the top plate 14 could also be used. The spacer plate would be maintained between the hydraulic valve bank and the valve mounting plate 20 and have the advantage of being a single piece rather than the multiple pieces as would be the case with the spacers.

The valve mounting plate 20 is also provided with a pair of tapped holes 32 and 34 at respective forward and rearward areas of the plate. These holes are provided to enable the attachment of conventional eye bolts (not shown) or other hoist attachment means. When the valve bank is being removed the eye bolts will be threaded into these tapped holes and a lifting chain will be connected to the eye bolts. After the bolts 22 are removed and all the fixtures are disconnected from the valve bank from inside the front portion of the loader vehicle the entire hydraulic valve bank can be lifted out as an assembly. This is much simpler than trying to extract the valve bank through the bottom of the front portion.

The crux of the invention is that the valve assembly generally 24 can be removed from above the vehicle rather than having to drop the valve assembly through the open bottom of the front frame member. Since the valve assembly 24 is fastened to the valve mounting plate 20 the removal of the valve mounting plate, after removing the four bolts 22, will include the valve assembly as long as the fasteners 26 are left fastened and all the attached plumbing is removed from the valve assembly.

When reinstalling the valve bank, the valve bank, which is attached to the valve mounting plate, is lowered into position through the use of a hoist and then bolted with fasteners 22 in the appropriate location. A man will then work inside the front portion of the vehicle attaching the hydraulic fittings to the fitting receiving appertures of the valve bank.

Thus it will be apparent to those skilled in the art that there has been provided a valve bank mounting arrangement that satisfies the objects and advantages of this invention. Minor detail changes and modifications of the invention are contemplated by the inventor, such as, but not limited to, the means for attaching the eye bolts to the valve mounting plate. The embodiments set forth in this specification are the preferred embodiments of the invention although various changes may be made without departing from the scope of the invention and the invention is not to be considered limited to what is shown in the drawings and described in the specification.

What is claimed is:

1. In an articulated vehicle having a hydraulic system including a hydraulic valve bank with a plurality of hydraulic valves, the improvement comprising:

a front frame structure of said articulated vehicle defining an enclosure having a man access opening and having a top plate having an outer surface, said top plate having a valve bank access port, and a plurality of small apertures arranged at the periphery of said valve bank access port;

a valve bank mounting plate having a first surface and having a plurality of apertures positioned on said top plate to cover said valve bank access port;

a valve bank carried on said first surface of said valve bank mounting plate, said valve bank having overall outside dimensions restricted to the height and width dimensions of said valve bank access port, said valve bank being hydraulically connected within said front frame structure to said vehicle hydraulic system;

a plurality of fasteners passing through said plurality of apertures in said valve bank mounting plate and said plurality of small apertures of said top plate whereby said valve bank mounting plate and said valve bank are fixed to said outer surface of said top plate with said first surface of said valve bank mounting plate adjacent said outer surface of said top plate.

2. The invention in accordance with claim 1 wherein said hydraulic valve bank further comprises a spacer having a thickness similar to the thickness of said top plate, said spacer interposed between said hydraulic valve bank and said first surface of said valve bank mounting plate.

3. The invention in accordance with claim 2 wherein said spacer comprises a plurality of spacers interposed between said hydraulic valve bank and said first surface of said valve bank mounting plate.

4. The invention in accordance with claim 3 wherein said valve bank mounting plate apertures comprise a pair of threaded apertures for accommodating a pair of threaded lifting eyes.

5. The invention in accordance with claim 1 wherein said valve bank mounting plate apertures comprise a pair of threaded apertures for accommodating a pair of threaded lifting eyes.

6. The invention in accordance to claim 1 wherein said front portion top plate valve bank access port is a generally rectangular port having a length slightly larger than the length of said valve bank and the width slightly larger than the width of said valve bank.

7. The invention in accordance with claim 6 wherein said valve bank mounting plate is a generally rectangular plate having a length greater than the length of said valve bank access port and a width greater than the width of said valve bank access port.

8. The invention in accordance with claim 1 wherein said front frame structure houses a plurality of fittings and said valve bank with a plurality of fitting receiving ports whereby said fittings and said fitting receiving ports are aligned with said valve bank and positioned in said front frame structure.

* * * * *